United States Patent [19]

Reed

[11] Patent Number: 4,567,710

[45] Date of Patent: Feb. 4, 1986

[54] MULTIPLE GLAZED PANEL

[76] Inventor: Michael R. Reed, 5832 Farmington Ct., Hanover Park, Ill. 60103

[21] Appl. No.: 702,883

[22] Filed: Feb. 19, 1985

[51] Int. Cl.[4] ..... E04C 2/54

[52] U.S. Cl. ..... 52/790; 52/456; 264/296

[58] Field of Search ..... 52/788, 790, 456, 793, 52/807; 264/296

[56] References Cited

U.S. PATENT DOCUMENTS

| | | | |
|---|---|---|---|
| 3,276,177 | 10/1966 | Keller | 52/793 X |
| 3,308,593 | 3/1967 | Smith | 52/456 |
| 4,145,858 | 3/1979 | Dorman | 52/456 |

FOREIGN PATENT DOCUMENTS

| | | | |
|---|---|---|---|
| 2400320 | 7/1975 | Fed. Rep. of Germany | 52/790 |

*Primary Examiner*—Carl D. Friedman
*Attorney, Agent, or Firm*—A. G. Douvas

[57] ABSTRACT

A double-glazed, light-transmitting panel having a pair of plastic face sheets permanently bonded to and spaced by a mechanically interlocked I-beam grid core. The grid core employs an I-beam spacer attachment which comprises a plurality of I-beams each having a pair of identical flanges joined by an interconnecting web with each of the flanges being formed with a dovetail keyway, a plastic connector seated upon each I-beam flange and having a dovetail tongue engaging a mating dovetail keyway, and an adhesive layer bonding each face sheet to opposing connectors separated by the I-beams. An alternative embodiment for the plastic connector has a generally U-shaped cross section that snaps on the flange of the channel. A method for fabricating a plastic connector by using the I-beam flange as a mold is also disclosed.

10 Claims, 14 Drawing Figures

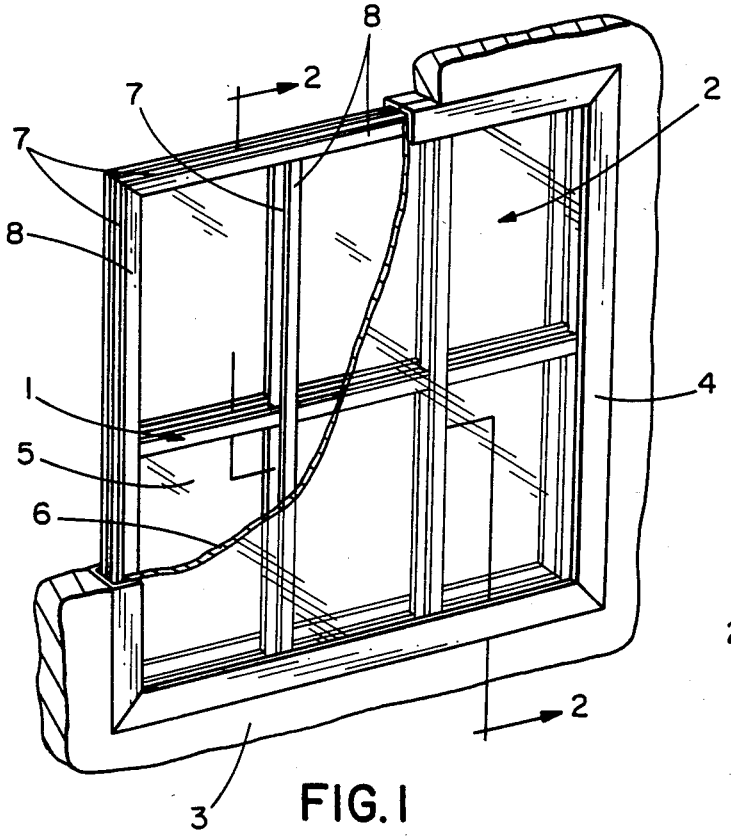
FIG. 1
FIG. 2
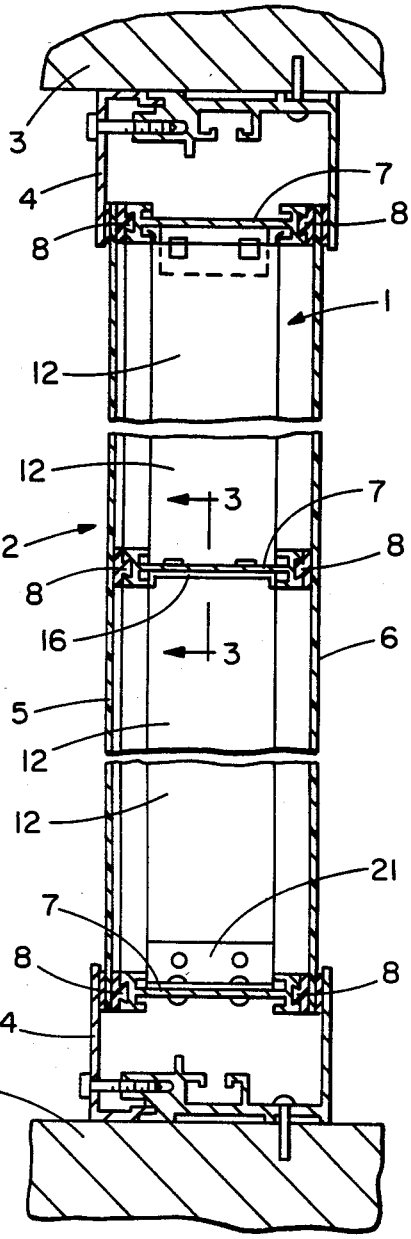
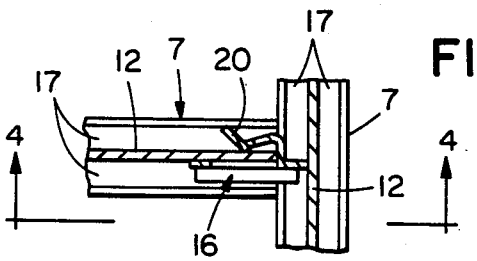
FIG. 3
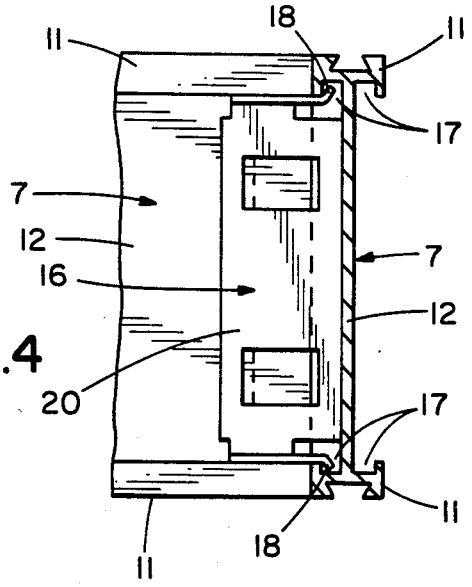
FIG. 4
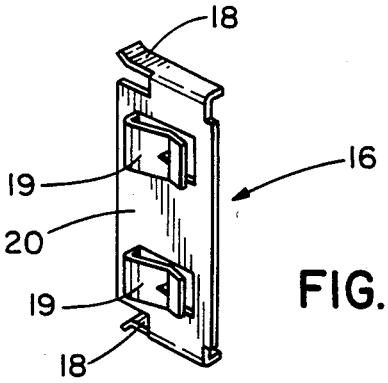
FIG. 5

MULTIPLE GLAZED PANEL

FIELD OF THE INVENTION

This invention relates to multiple glazed construction panels in which plastic face sheets are adhesively joined to metallic grid cores.

BACKGROUND OF THE INVENTION

Double glazed light-transmitting panels constructed from a pair of plastic face sheets permanently bonded to and spaced by a metal grid core are well known in the prior art. Panels of this type are used in windows, walls, skylights and roofs. In the usual installation, the panels are fabricated with translucent plastic face sheets which allow natural light to enter a building. The double glaze construction with plastic face sheets also conserves energy because of the improved insulating characteristics of the panel.

The grid cores which support and space the face sheets are usually fabricated from metal elements, such as, I-beams and U-shaped channels in order to provide the requisite panel strength. The joining of plastic face sheets to metal grid core elements introduces serious delamination when the panel is subject to a broad range of temperature variations, or the temperature gradient is relatively large when measured from one face sheet to the other. This delamination is caused by the shearing action of the differential rare of thermal expansion of the two dissimilar materials employed, namely, the plastic used in the face sheets and the metal beams and channels used in the grid core.

STATEMENT OF THE INVENTION

Accordingly, a principal object of this invention is to improve the durability and the thermal insulation capability of multiple glazed panels employing dissimilar materials in the face sheets as compared to the grid core which supports and spaces the face sheets.

Another object is to substantially eliminate the delamination occurring between a plastic face sheet and a metal grid core of a multiple glazed panel.

Another object is to improve the adhesive bond between a plastic face sheet and a metal grid core of a multiple glazed panel.

A principal structural feature for attaining the foregoing objects relates to an improved grid core design employing a novel I-beam spacer attachment. In particular, the grid core is fabricated with a plurality of extruded aluminum I-beams each having a pair of identical flanges joined by an interconnecting web with each of the flanges being formed with a dovetail keyway. A plastic connector is seated upon each I-beam flange. Each connector has a dovetail tongue which engages a mating dovetail keyway of the I-beam flange. All of the connectors are preferably fabricated of the same plastic as the panel face sheets. An adhesive bonds each face sheet to its otherwise contacting and supporting connector. An improved adhesive bond is effected because the plastic face sheets are bonded to the grid core at plastic-to-plastic junctions.

In a second preferred embodiment, rhe plastic connector is designed with a U-shaped cross section having flexible sidewalls. The connector can be snapped or slipped into locking attachment with an I-beam flange that is formed without the keyway of the first preferred embodiment.

DETAILED DESCRIPTION OF THE DRAWINGS

In order that all of the structural features of this invention may be readily understood, reference is made to the accompanying drawings wherein:

FIG. 1 is a perspective view of the double glazed panel of this invention incorporated within a window frame;

FIG. 2 is a section view taken along line 2—2 of FIG. 1 which shows the double glazed sandwich construction employed in the panel:

FIG. 3 is a section view taken along line 3—3 of FIG. 2, and FIG. 4 is a section view taken along line 4—4 of FIG. 3 which shows the attachment of two I-beams employed in the panel grid core by a prior art metal clip;

FIG. 5 is a perspective view of the attachment clip;

DETAILED DESCRIPTION OF THE PREFERRED EMBODIMENTS

A double glazed panel 1 incorporating the design features of this invention is shown in FIGS. 1 and 2 as part of a light-transmitting window 2 positioned in building wall 3 by metallic frame 4.

Figure 6:
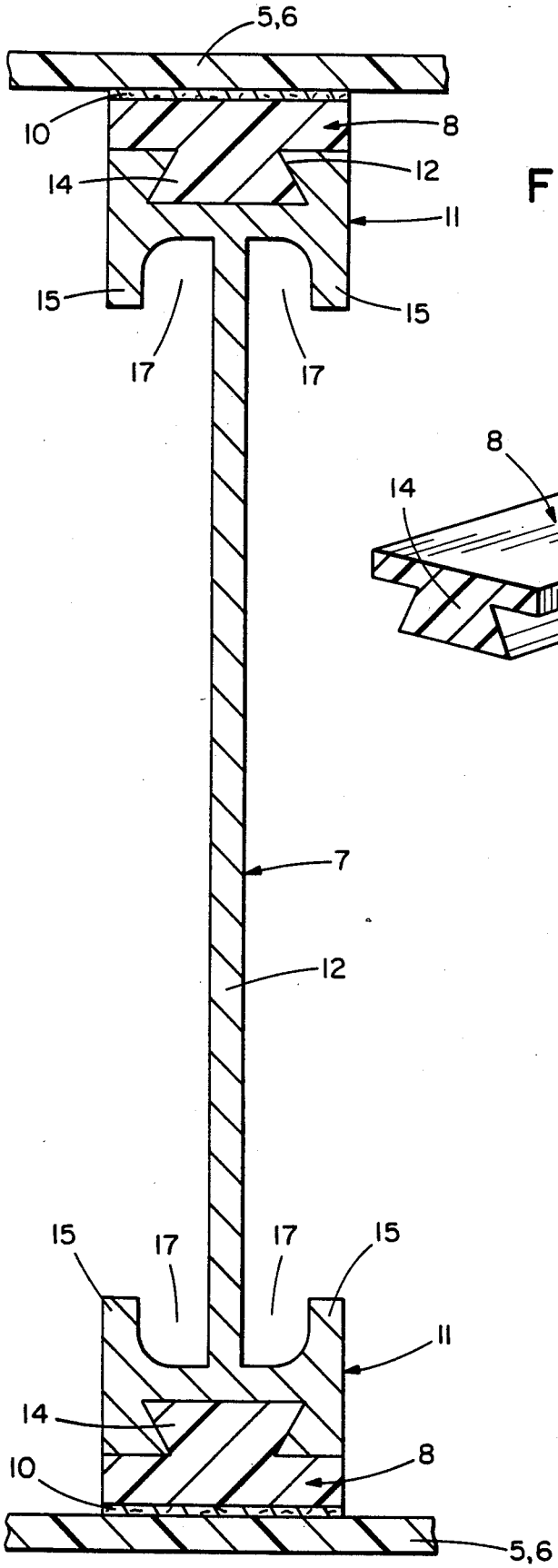
FIG. 6 is an enlarged section view of a preferred embodiment of an I-beam spacer attachment employed in the double glazed panel of FIG. 1.

Panel 1 is a light-transmitting panel having a pair of face sheets 5 and 6 permanently bonded to and spaced by a grid core fabricated from a plurality of mechanically interlocked I-beams 7 (FIG. 6). In a preferred embodiment, face sheets 5 and 6 are translucent fiberglass sheets of fiber reinforced polyester resin and I-beams 7 are extruded aluminum I-beams. Face sheets 5 and 6 may be fabricated from other resins depending upon the particular face sheet characteristics desired, such as, light transmissivity, impact resistance, fire properties, and weatherability. Similarly, I-beams 7 may be fabricated from metals other than aluminum; and the grid pattern may differ from the rectangular pattern shown in FIGS. 1 and 2.

A principal shortcoming of many prior art multiple glazed panel designs employing plastic face sheets bonded to a metallic grid core relates to the thermal delamination of the face sheets from the metallic surfaces of the grid core to which the sheets are bonded. This delamination is caused by the shearing action of the differential rate of thermal expansion of the two dissimilar materials.

Accordingly, a principal feature of the panel unit of this invention is the use of a plastic connector 8 (FIGS. 1, 2, 6–8), plastic connector 8' (FIGS. 10–12), or in a second preferred embodiment a plastic connector 9 (FIGS. 13, 14) sandwiched between I-beam 7 and plastic face sheets 5 and 6 with bonding agent 10 (FIGS. 6, 8, 12, 14) being applied between two plastic surfaces. Delamination is substantially eliminated because face sheets 5 and 6 are bonded to I-beams 7 of the grid core at plastic-to-plastic junctions. The use of a plastic connector 8, 8' or 9 is compatible with the use of a much stronger bonding agent 10 because two similar materials are being bonded having substantially the same temperature coefficient of expansion rather than two dissimilar materials having very different temperature coefficients of expansion.

If face sheets 5 and 6 are fabricated from a fiber reinforced polyester resin, plastic connectors 8, 8', or 9 are also preferably constructed from the same or a similar polyester formulation. The connectors do not need to be fiber reinforced. Bonding agent 10 may be a rapid, room-temperature curing modified epoxy structural adhesive with high shear and peel strengths. "Scotch-Weld" brand structural adhesive 3501 B/A sold by 3M, St. Paul, Minn., is an example of a satisfactory agent.

As is shown in FIG. 6, for a double glazed panel the pair of separated face sheets 5 and 6 are fixedly positioned by a grid core in which I-beam 7 and a pair of connectors 8 locked to the I-beam comprise the principal attachment elements. In particular, I-beam 7 is formed with a pair of identical flanges 11 joined by a thin web 12. The portion of each flange 11 adjacent a face sheet 5 or 6 is grooved to define a dovetail keyway 13. Each keyway 13 receives in locking engagement a mating dovetail tongue 14 (FIG. 7) which is an integral part of connector 8.

Each flange 11 is formed with a pair of spaced lips 15 which are removed from the adjacent portions of web 12 to define a pair of clip attachment grooves 17 for clip 16 (FIGS. 3–5). Clip 16 is part of the prior art, and the use of a clip of its particular design to join together two or more I-beams to form a grid core for a double glazed panel is well known in the art. However, the novel attachment of this invention featuring plastic connectors 8, 8' and 9 seated upon and locked to I-beam flanges 11, 11' and 33, respectively, requires a defined grid core in which each I-beam section must be temporarily held in its appropriate place in the grid until face sheets 5 and 6 are permanently bonded to connectors 8, 8' or 9 by bonding agent 10 applied between the contacting surface of face sheets 5 and 6 and its supporting connector. The permanent bond effected by the bonding agent locks the several I-beams 7 loosely held together by clip 16 into a rigid durable panel.

In the assembly of the grid core, clip 16 is used to hold together two I-beam sections which are joined at a T-junction (FIGS. 3 and 4). Clip 16 is preferably a metal part stamped to form two latching fingers 18 and two clamping fingers 19 (FIG. 5) which project from clip body 20. When in use, clip 16 is seated upon web 12 of a first I-beam 7 by clamping web 12 between the pair of clamping fingers 19 and clip body 20. The pair of latching fingers 18 is also lodged into attachment grooves 17 of the second I-beam 7 which forms the T-junction with the first I-beam.

The corner junctions of the grid core are formed by two mitered I-beams 7 (see the upper left corner of the grid core as shown in FIG. 1). Each corner junction is held together permanently by riveting a right-angle bracket 21 to the web 12 surfaces internal to the grid core (see the lower corner of the grid core as shown in FIG. 2).

Figure 7:
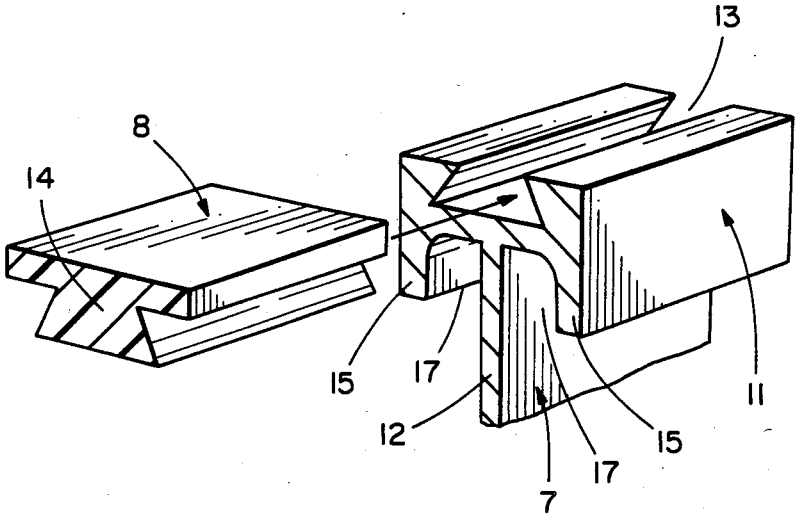
FIG. 7 is a perspective view of the I-beam attachment of the first preferred embodiment which shows the dovetail tongue of the connector and its mating keyway formed in the I-beam flange.
Figure 8:
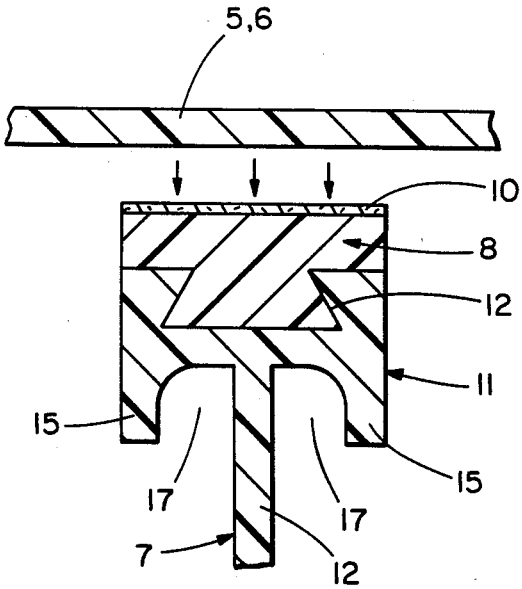
FIG. 8 shows a panel face sheet about to be placed upon a layer of bonding agent applied to a contact surface of a connector locked to an I-beam flange.

In the I-beam attachment of the first preferred embodiment shown in FIG. 7, connector 8 is an elongated plastic element whose dovetail tongue 14 is forcibly slipped into mating dovetail keyway 13. An efficient dovetail lock is formed which is dependent upon a tight friction fit between dovetail elements 13 and 14.

Figure 9:
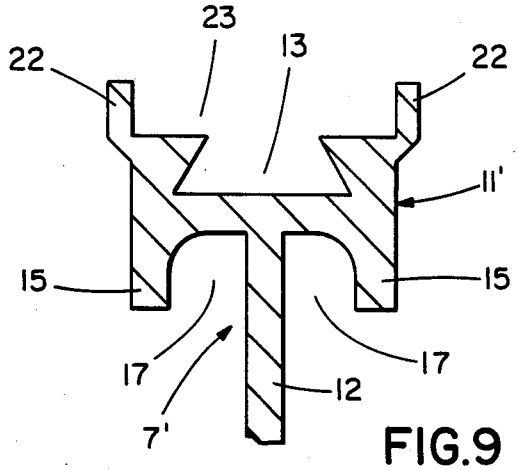
FIG. 9 shows a modification in an I-beam flange which employs a set of projecting retaining walls to form a plastic mold which enables the connector to be fabricated from a plastic poured directly into the keyway.
Figure 10:
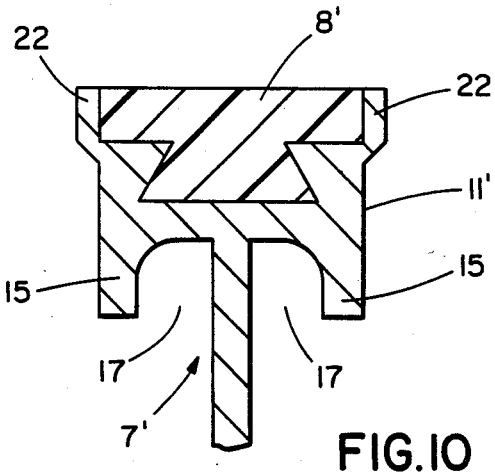
FIG. 10 shows the connector mold formed by structure of FIG. 9 filled with a poured plastic.
Figure 11:
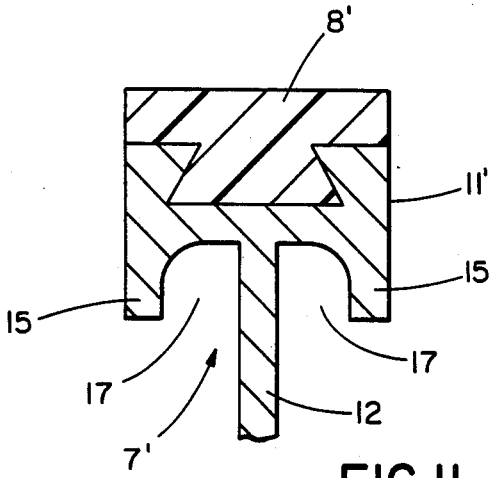
FIG. 11 shows the I-beam flange and its locked connector after the retaining walls are milled away.

A dovetail lock, which is more effective than sliding connector 8 into the keyway 13, is formed by modifying I-beam flange 11 to include a pair of parallel-spaced sidewalls 22 (FIG. 9) to form an enlarged flange 11' for I-beam 7'; the resulting enlarged cavity formed by keyway 13 and space 23 is used as a mold for a poured plastic connector 8' (FIG. 10). The liquid plastic is sufficiently viscous that the ends of the cavity formed by keyway 13 and space 23 need not be blocked by an endwall. To the extent that the cavity is not filled with plastic to the upper edge of sidewalls 22, I-beam 7' can be cut and only the I-beam portion with a fully formed connector 8' can be used in the construction of a panel grid core.

Figure 12:
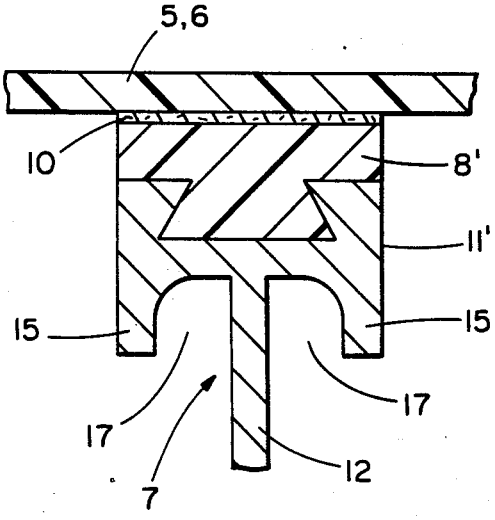
FIG. 12 is related to FIG. 11 as it shows a face sheet bonded to the connector of FIG. 11.

After the thermosetting plastic used to form connector 8' has cured, the projecting sidewalls 22 are milled off to expose completely the sides of connector 8' (FIG. 11) so that both connectors 8 and 8' have the same cross-sectional configuration. Connector 8' is in intimate cohesive contact with flange 11' of I-beam 7', whereas, connector 8 depends solely upon a tight friction fit with flange 11 of I-beam 7. Adhesive layer 10 bonds face sheets 5 and 6 to a supporting connector 8' (FIG. 12).

Figure 13:
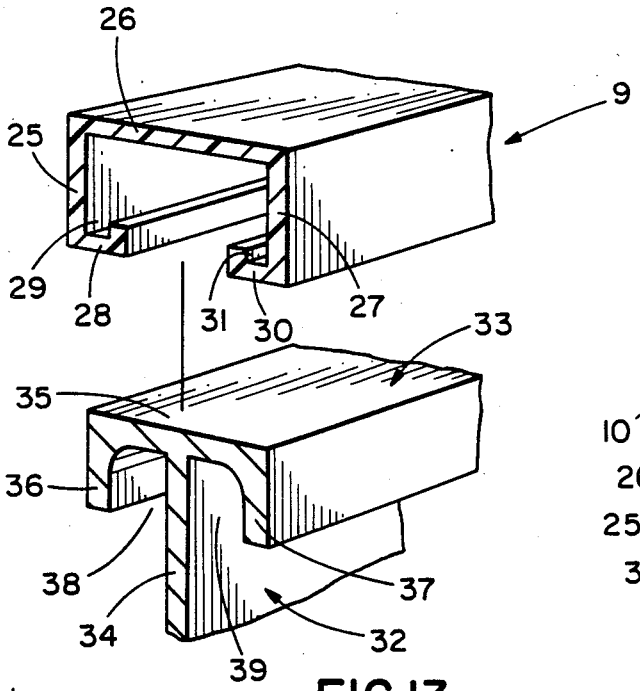
FIG. 13 shows a second preferred embodiment of an I-beam spacer attachment designed to receive a generally U-shaped snap plastic connector.
Figure 14:
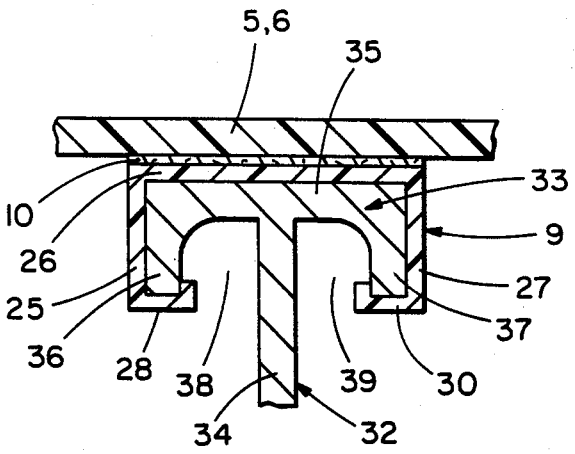
FIG. 14 is related to FIG. 13 as it shows a face sheet bonded to the connector of FIG. 13.

A second preferred embodiment of an I-beam spacer attachment is shown in FIGS. 13 and 14. In this embodiment, the elongated body of plastic connector 9 is formed by a set of three sidewalls 25, 26 and 27 joined together to establish a U-shaped cross-section channel. A right-angle lip 28 projects from the lower edge of sidewall 25 to define a locking groove 29, and a right-angle lip 30 projects from the lower edge of sidewall 27 to define a locking groove 31. Both locking grooves 29 and 31 extend for the entire length of connector 24.

Metal I-beam 32 comprises a pair of flanges 33 (only one of which is shown in FIGS. 13 and 14) joined by web 34. Each flange 33 has a relatively thin connector support 35 which forms a T-junction with web 34 of I-beam 32. Lips 36 and 37 project from the edges of support base 35 to define grooves 38 and 39, respectively.

Connector 9 may be fabricated from a plastic which enables connector sidewalls 25 and 27 to flex relative to support base 34. With this flexible construction, connector 9 can be snapped into engagement with flange 33 as is shown in FIG. 14. Alternatively, if sidewalls 25 and 27 are incapable of sufficient flexing to enable connector to be snapped into engagement which I-beam 32, then connector 9 can be slipped into engagement with flange 33.

In any event, connector 9 is locked into place due to the nesting of flange lips 36 and 37 into grooves 29 and 31, respectively. Adhesive layer 10 bonds face sheets 5 and 6 to a supporting connector 9 (FIG. 14).

The inclusion of plastic connector elements 8, 8' and 9 in the grid core designs of this invention also improves the thermal insulation qualities of double-glazed panels. Plastic face sheets 5 and 6 are thermally isolated from the heat-conducting aluminum I-beams 7 by the plastic bodies of the connectors.

It should be understood that the above described designs are merely illustrative of the principles of this invention and modification can be made without departing from the scope of the invention.

What is claimed is:

1. In a double-glazed, light-transmitting panel having a pair of plastic face sheets permanently bonded to and spaced by a mechanically interlocked metal grid core, a grid core having an improved face sheet spacer attachment comprising a plurality of mechanically interlocked beams each having a pair of flanges joined by an inrer-connecting web with each of the flanges being formed with a connector locking keyway, a plastic connector seated upon each beam flange and having a locking tongue engaging a mating keyway and with each connector being fabricated of a plastic having substantially the same temperature coefficient of expansion as the plastic face sheets, and a plurality of adhesive layers bonding each face sheet to opposing connectors separated by the beams.

2. The combination of claim 1 in which the face sheets and the connectors have essentially the same temperature coefficient of expansion.

3. The combination of claim 2 in which the face sheets and the connectors have essentially the same plastic formulation.

4. The combination of claim 1 in which the connector locking keyway and connector locking tongue have mating dovetail cross-sections.

5. The combination of claim 1 in which the plurality of beams are I-beams.

6. The combination of claim 5 in which the plastic face sheets are fabricated of translucent fiberglass reinforced polyester resin and the beams are aluminum I-beams.

7. In a double-glazed, light-transmitting panel having a pair of plastic face sheets permanently bonded to and spaced by a mechanically interlocked metal grid core, a grid core having an improved face sheet spacer attachment comprising a plurality of beams each having a pair of flanges joined by an interconnecting web, a plastic connector seated upon each flange and having a cross-section which locks to each flange and with each connector being fabricated of a plastic having substantially the same temperature coefficient of expansion as the plastic face sheets, and a plurality of adhesive layers bonding each face sheet to opposing connectors separated by the beams.

8. The combination of claim 7 in which each plastic connector has a generally U-shaped cross-section in which each of the spaced legs defining the sides of the generally U-shaped connector is formed with a locking lip which engages a mating beam flange.

9. The combination of claim 8 in which the plurality of beams are I-beams.

10. A method of fabricating a double-glazed, light-transmitting panel having a pair of plastic face sheets permanently bonded to and spaced by a mechanically interlocked I-beam grid core, with the grid core employing I-beam spacer attachments each formed from a plurality of I-beams having a pair of identical flanges joined by an interconnecting web with each of the flanges having a dovetail keyway and a pair of spaced sidewalls defining a plastic cavity mold comprising the steps of pouring a liquid plastic into the plastic cavity mold to form a plastic connector locked to each flange, removing the sidewalls from the flange, and bonding the pair of face sheets in a spaced relationship to the connectors formed in each I-beam flange.

* * * * *